US010954717B2

(12) United States Patent
Sailer et al.

(10) Patent No.: US 10,954,717 B2
(45) Date of Patent: Mar. 23, 2021

(54) STEP ASSEMBLY

(71) Applicant: VAF Industries, LLC, Escondido, CA (US)

(72) Inventors: Glenn Sailer, Escondido, CA (US); Raymond Tai, San Marcos, CA (US)

(73) Assignee: VAF Industries, LLC, Escondido, CA (US)

( * ) Notice: Subject to any disclaimer, the term of this patent is extended or adjusted under 35 U.S.C. 154(b) by 1 day.

(21) Appl. No.: 16/525,963

(22) Filed: Jul. 30, 2019

(65) Prior Publication Data

US 2020/0048964 A1 Feb. 13, 2020

Related U.S. Application Data

(60) Provisional application No. 62/716,459, filed on Aug. 9, 2018.

(51) Int. Cl.

| | |
|---|---|
| ***E06C 9/00*** | (2006.01) |
| ***E06C 9/02*** | (2006.01) |
| ***E06C 7/18*** | (2006.01) |

(52) U.S. Cl.
CPC . *E06C 9/02* (2013.01); *E06C 7/18* (2013.01)

(58) Field of Classification Search
CPC ..... A63B 27/00; A62B 35/0068
USPC ..... 248/235, 240, 218.4; 182/90, 92
See application file for complete search history.

(56) References Cited

U.S. PATENT DOCUMENTS

| | | | | |
|---|---|---|---|---|
| 4,932,497 | A * | 6/1990 | Raso | A63B 27/00 182/189 |
| 5,743,353 | A * | 4/1998 | Browning | A63B 27/00 182/92 |
| 5,944,139 | A * | 8/1999 | Kozial | A63B 27/00 182/92 |
| 6,378,822 | B1 * | 4/2002 | Franks | E06C 1/34 182/90 |
| 6,491,272 | B1 * | 12/2002 | Franks | E06C 1/34 182/92 |
| D805,658 | S * | 12/2017 | Sailer | D25/69 |
| 10,112,078 | B1 | 10/2018 | Sailer et al. | |
| D844,179 | S * | 3/2019 | Sailer | D25/69 |
| 2002/0066620 | A1 * | 6/2002 | Lindsey | E06C 1/34 182/92 |
| 2009/0045012 | A1 * | 2/2009 | Mencl | A63B 27/00 182/92 |

* cited by examiner

*Primary Examiner* — Steven M Marsh
(74) *Attorney, Agent, or Firm* — LambentIP

(57) ABSTRACT

Disclosed is a step assembly for use in climbing a utility structure. The step assembly comprises a rod member and a plate member. The rod member comprises a generally L-shaped rod, a shoulder formed contiguously to the generally L-shaped rod, and an arm pivotably coupled to the shoulder by a pin. The plate member comprises a duct having a longitudinally formed internal passage, and a support plate attached at one end portion of the duct and formed transversally to the duct, wherein the internal passage of the duct contiguously provides an opening in the support plate at the one end portion. The aligned shoulder and arm are configured to pass through the internal passage.

15 Claims, 10 Drawing Sheets

STEP ASSEMBLY

CROSS-REFERENCE TO RELATED APPLICATION

This application claims the benefit of U.S. Provisional Patent Application Ser. No. 62/716,459 filed on Aug. 9, 2018.

BACKGROUND

The present invention broadly relates to equipment for climbing utility structures, such as utility towers and utility poles.

Fall arrest is one form of fall protection, regulations of which are specified by OSHA to prevent individuals working at height from fall injury. Personal fall arrest is one type of fall arrest, and a personal fall arrest system typically includes at least the following four key elements: anchorage, body wear, connector and deceleration device. An anchorage is a secure point, often referred to as a tie-off point, for attachment to a structural part such as a rebar, I-beam, scaffolding and the like. A body wear is typically a body harness worn by the worker. A deceleration device has a mechanism to dissipate a substantial amount of energy and force associated with a fall arrest event. Examples of deceleration device include a rope grab, shock-absorbing lanyard, fall limiter, self-retracting lifeline and the like, one end of which can be coupled to a body wear. A connector is a device used to couple the other end of the deceleration device to the anchorage, e.g., a cross-arm strap, beam anchor, snap-hook, carabiner, etc. Each of these parts of a personal fall arrest system is typically required to sustain a minimum of 5,000 pounds per worker.

A utility tower is typically constructed to have threaded holes, which are configured to engage with threaded step rungs. Such a step rung is typically formed to have a shape of a bolt, i.e., an elongated solid cylinder with a threaded end portion, which is fastened with a fastener such as one or more nuts to secure the engagement with the threaded hole. A utility pole is typically constructed to have holes where step rungs are to be inserted. The end portion of such a step rung may include a hook, clip or the like properly shaped for securing the step rung through the hole.

Utility workers climb utility structures for repair, construction, maintenance and other purposes, with a variety of safety equipment. Conventional techniques addressing fall arrest in climbing a utility tower or pole include the use of a separate part, such as a carabiner, climbing clip, hook and the like, to couple the deceleration device to the step rung installed with the structure. Other examples include a step rung integrated with an attachment to allow the climber to hook in a hook or clip at the end of the deceleration device. However, these conventional techniques often fail to meet the requirement of supporting a load of 5,000 pounds or greater per worker. Therefore, there is a need for an easily installable step rung with high reliability and safety.

DETAILED DESCRIPTION

This document describes a step assembly, which can be securely installed to and uninstalled from a utility tower or a utility pole.

Figure 1:
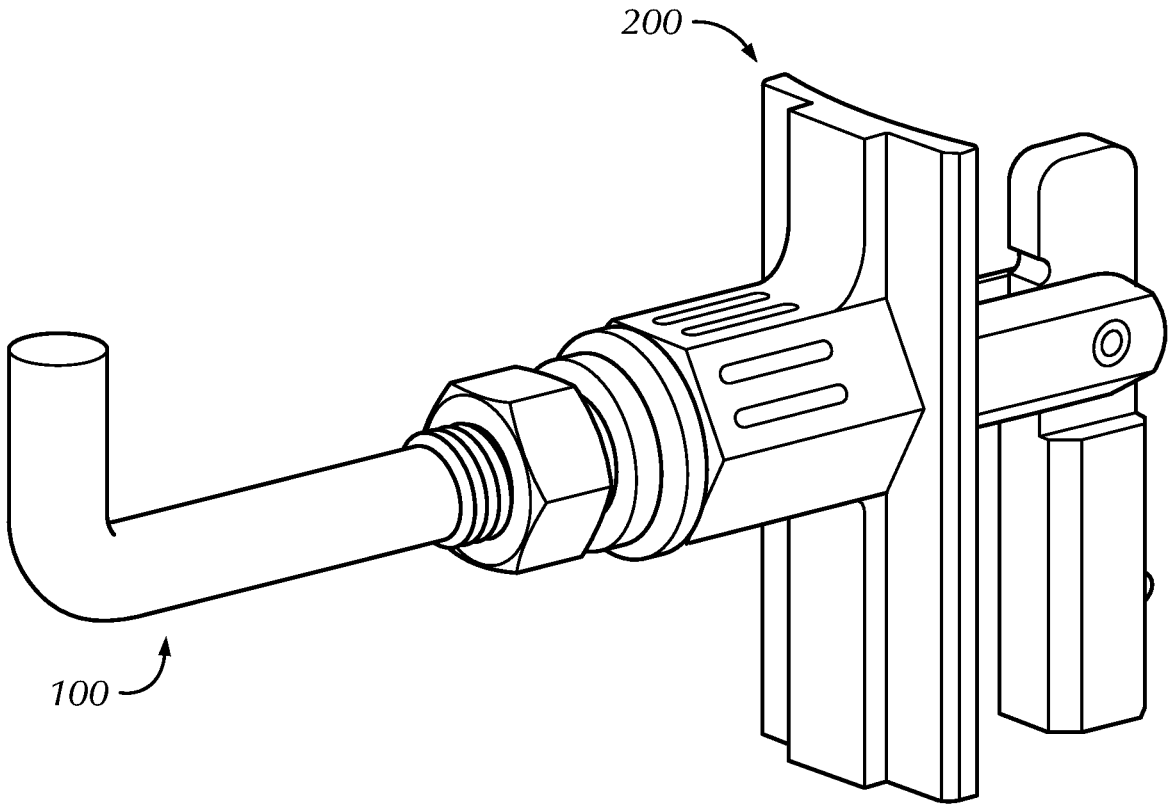
FIG. 1 is a front perspective view of a first embodiment of the present step assembly, in an assembled configuration.
Figure 2:
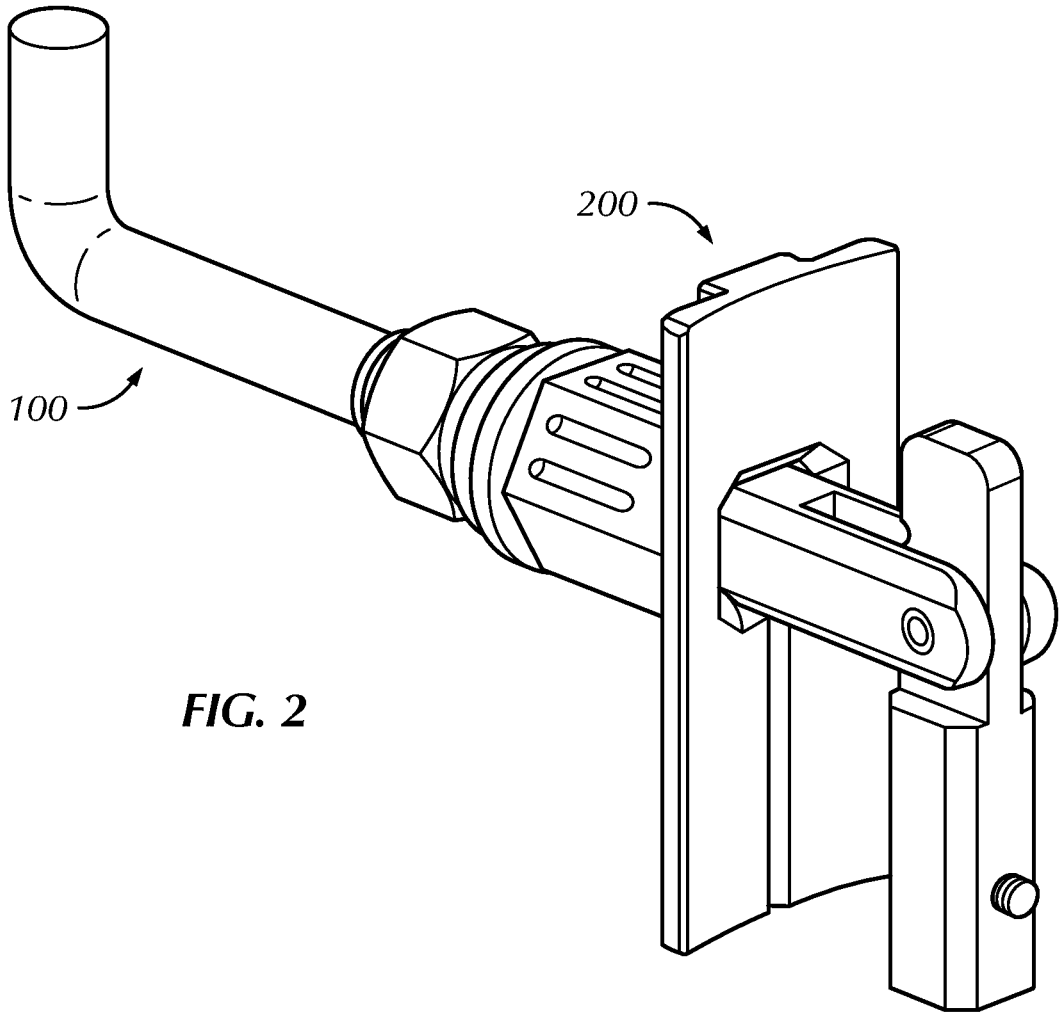
FIG. 2 is a rear perspective view thereof.
Figure 3:
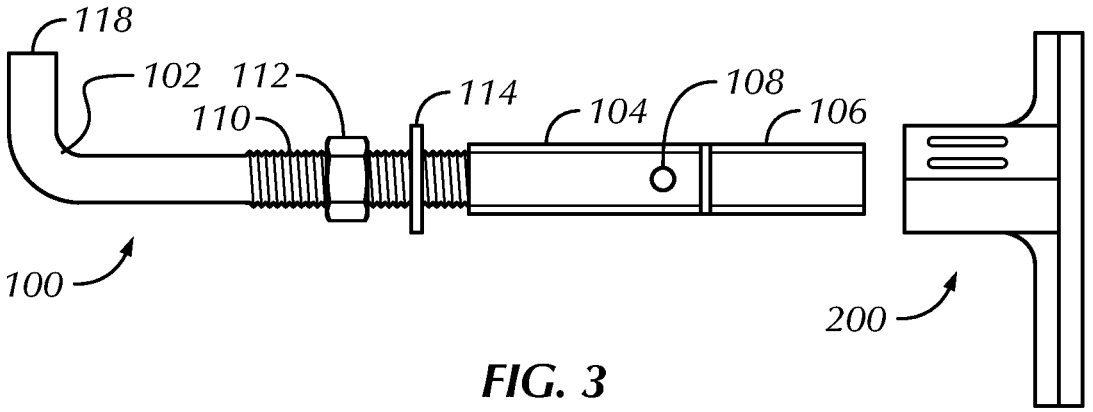
FIG. 3 is a side view of the present step assembly, in a disassembled configuration, separately showing a rod member and a plate member, wherein an arm of the rod member is pivoted back to generally align with a shoulder.

Details of the structure and mechanism of the present step assembly, according to a first embodiment, are explained below with reference to FIGS. 1-14. FIG. 1 is a front perspective view of the present step assembly, in an assembled configuration. FIG. 2 is a rear perspective view thereof. FIG. 3 is a side view of the present step assembly, in a disassembled configuration, separately showing a rod member 100 and a plate member 200. The present step assembly includes two main components: the rod member 100 and the plate member 200. FIGS. 4-7 show details of the rod member 100 from various views. FIGS. 8-12 show details of the plate member 200 from various views. The present step assembly may be made of stainless steel, low carbon steel, aluminum, or other metals or alloys.

The rod member 100 comprises one portion formed to be a generally L-shaped rod 102 and the other portion formed to have a shoulder 104 and an arm 106 that is pivotably coupled to the shoulder 104 by a pin 108. The generally L-shaped rod 102 has a main rod elongated in the longitudinal direction and a bent portion 118 elongated in the transversal direction and formed contiguously to one end of the main rod. In this example, a thread 110 is formed on the surface of the other end portion of the main rod, wherein the other end portion is opposite to the bent portion 118 and formed contiguous to the shoulder 104. The shoulder 104 is formed longitudinally and contiguously to the other end of the main rod. The thread 110 may be formed to extend partially or all the way toward the bent corner of the generally L-shaped rod 102 where the bent portion 118 is connected transversally. The surface other than the threaded surface 110 of the generally L-shaped rod 102 may be knurled for a better grip. Fasteners such as one or more nuts 112 and one or more washer 114 may be included as auxiliary components in the rod member 100. Alternatively, the nut 112 may be a flange nut; and the washer 114 may be eliminated. Further alternatively, a regular hex nut with a flat washer, a lock washer, or any combination of the same or different types of washers may be used. The fasteners, once added around the thread 110 of the present step assembly, cannot easily slide out of the rod member 100 because the L-shaped bending prevents it. Therefore, these small parts do not get lost during general handling by workers.

Figure 4:
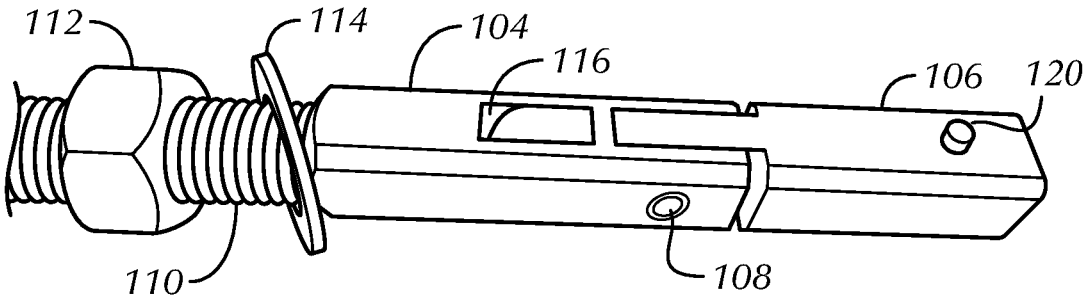
FIG. 4 is a top perspective view of a portion of the rod member, showing a configuration wherein the arm is pivoted back to generally align with the shoulder.
Figure 5:
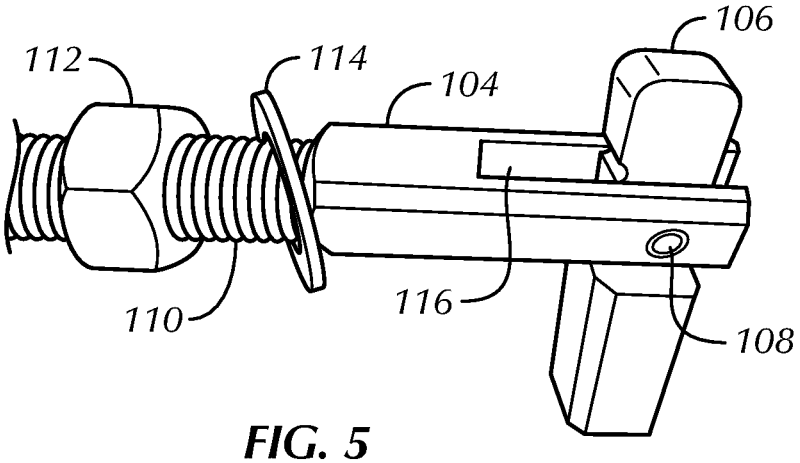
FIGS. 5-7 are a top perspective view, a side view and a bottom perspective view, respectively, of the rod member, showing a configuration wherein the arm is hanging down, i.e., being pivoted by roughly 90° with respect to the shoulder.
Figure 6:
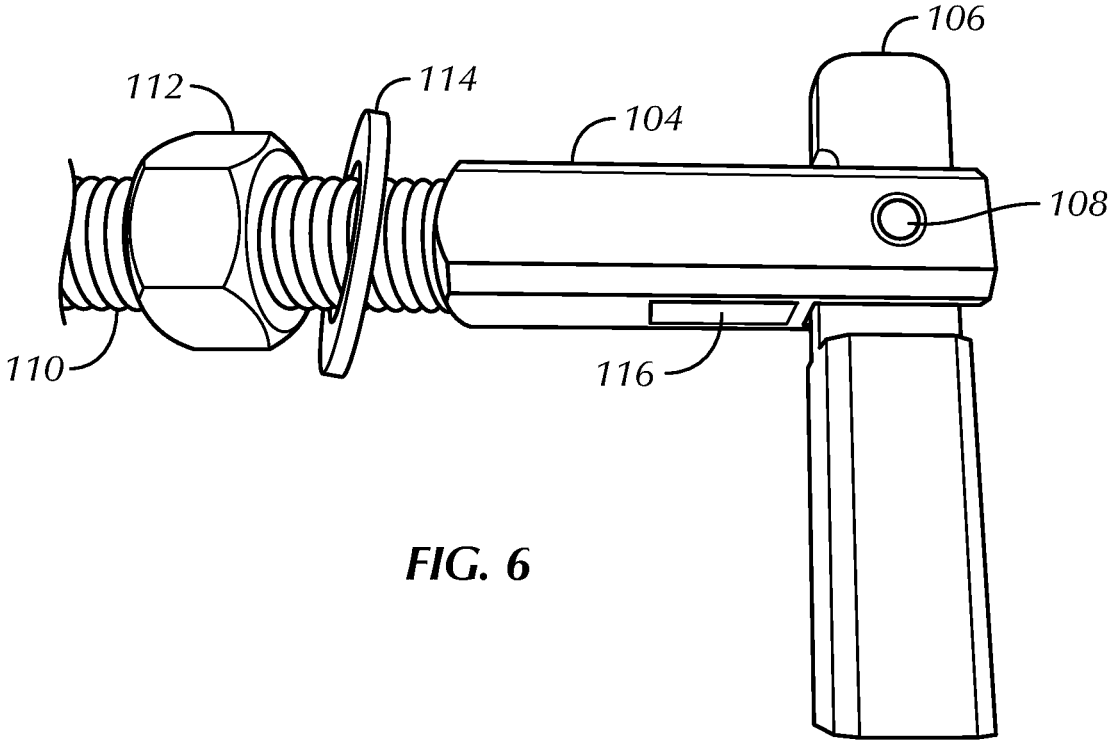
Figure 7:
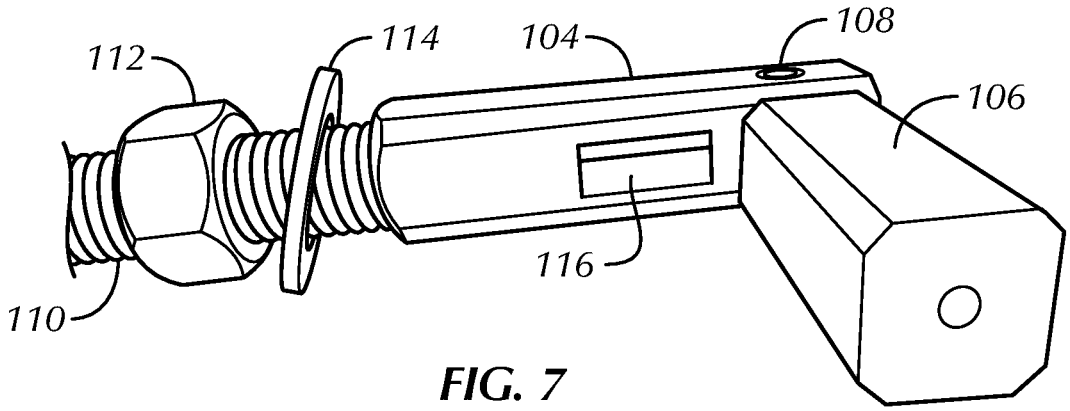
Figure 8:
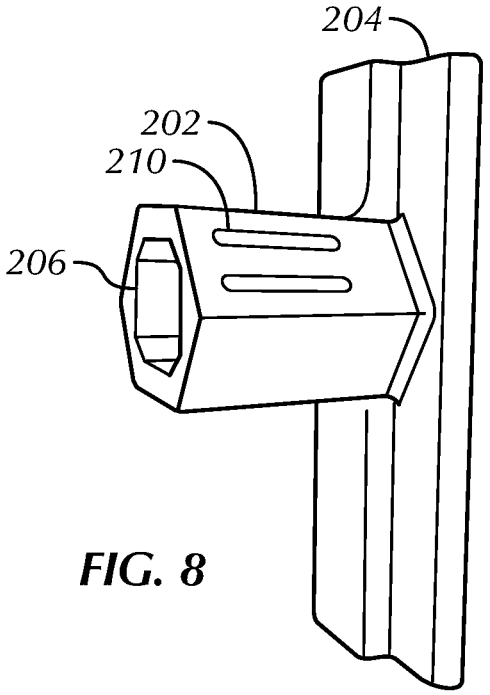
FIGS. 8-12 are a side perspective view, a front view, a rear perspective view, a top perspective view and a bottom perspective view, respectively, of the plate member.
Figure 9:
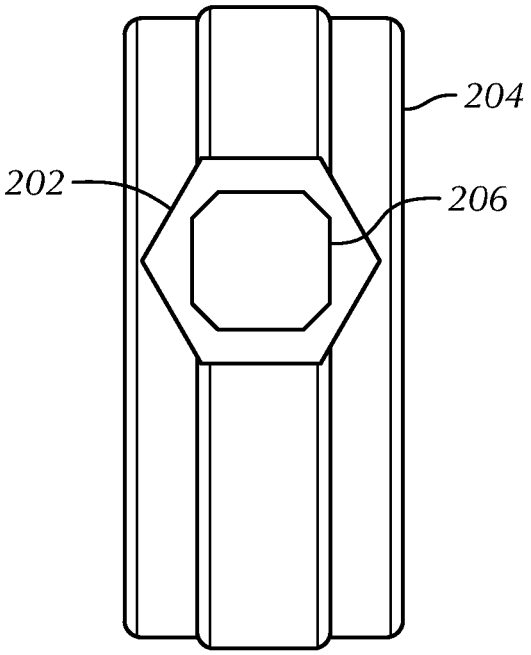
Figure 10:
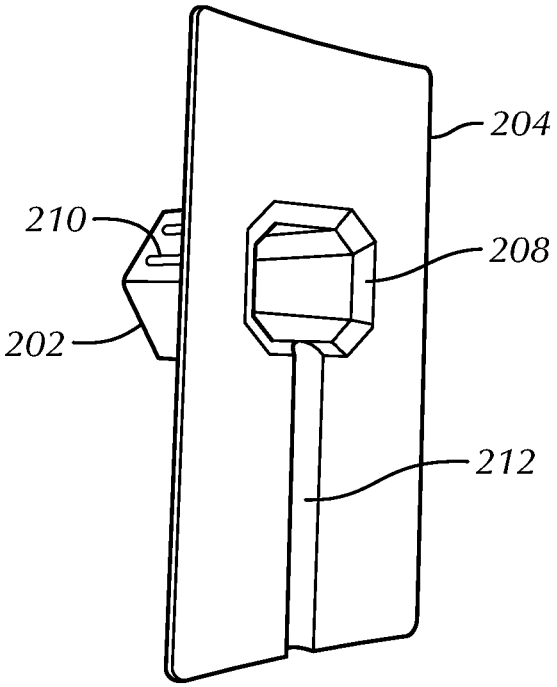
Figure 11:
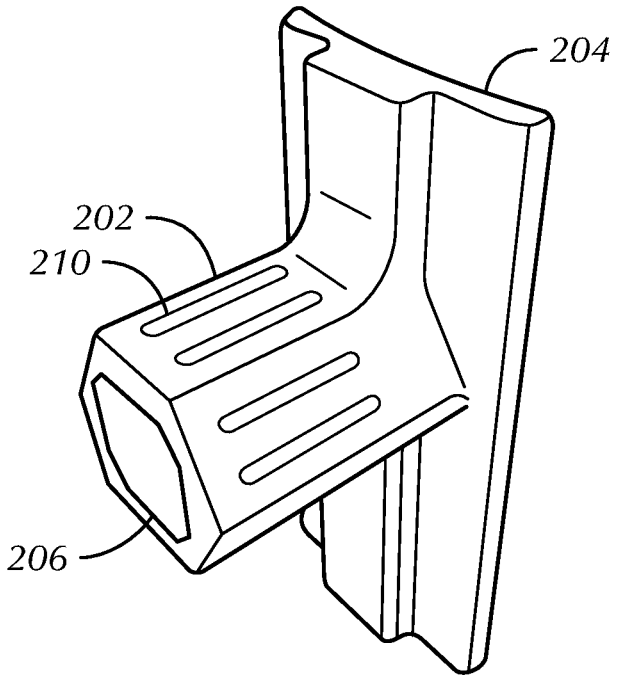
Figure 12:
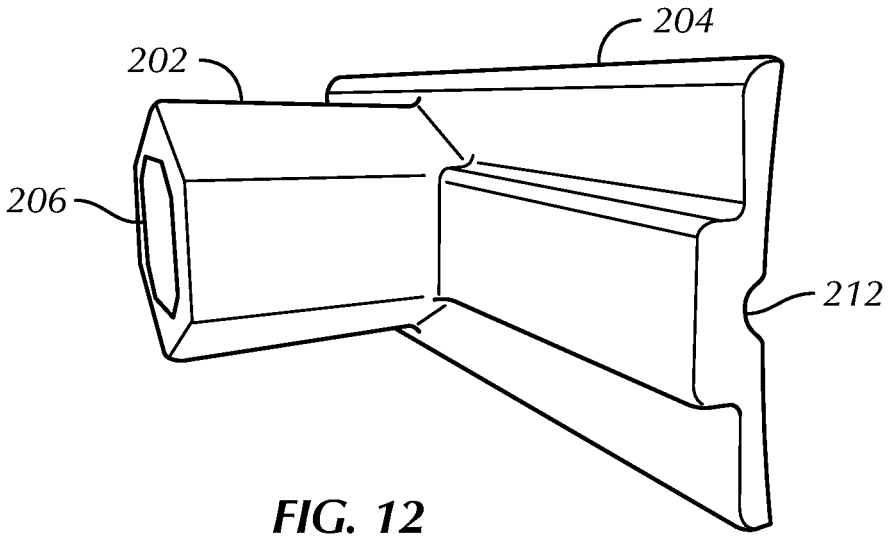

FIG. 4 is a top perspective view of the rod member 100, showing a configuration wherein the arm 106 is pivoted back around the pin 108 to generally align with the shoulder 104. FIGS. 5-7 are a top perspective view, a side view and a bottom perspective view, respectively, of the rod member 100, showing another configuration wherein the arm 106 is pivoted around the pin 108 by roughly 90° with respect to the shoulder 104. The pin 108 couples the shoulder 104 and the arm 106 as an axis, so as to enable the pivotal movement of the arm 106 around the pin 108 radially on the plane generally defined by the shoulder 104 and the arm 106. The axial direction of the pin 108 is orthogonal to the direction of the bent portion 118 of the generally L-shaped rod 102. The pin 108 is placed off-centered on the arm 106. Therefore, the arm 106 is divided into two sections: a proximal section and a distal section, the proximal section being shorter than the distal section extending toward the 180° opposite direction with respect to the location of the pin 108. This orthogonal orientation of the pin 108 with respect to the generally L-shaped rod 102, together with the off-centered placement of the pin 108 on the arm 106, enable the pivotal movement of the arm 106 naturally to let the longer distal section hang down vertically due to gravity, in a configuration in which the shoulder 104 is placed horizontally and the bent portion 118 of the generally L-shaped rod 102 is placed vertically upright. A socket 116 is formed in the shoulder 104 so as to accommodate the shorter proximal section of the arm 106 when the arm 106 is pivoted back to extend from and generally align with the shoulder 104. To enhance the smooth pivoting, the dimensions of the pin 108 and the hole in the arm 106, through which the pin 108 is inserted, can be configured so as to minimize the friction therebetween. A lubricant or oil may be used to further smoothen the contact.

A stopper 120 may optionally be included in the distal section of the arm 106. The stopper 120 may comprise a screw that can be turned to have its height higher than the surrounding surface of the arm 106, in the configuration wherein the arm 106 is inserted through the plate member 200, so as to prevent the arm 106 from sliding back out of the plate member 200. In this way, workers/users will less likely lose either member of the assembly prior to installation.

FIGS. 8-12 are a side perspective view, a front view, a rear perspective view, a top perspective view and a bottom perspective view, respectively, of the plate member 200. The plate member 200 comprises a duct 202 elongated longitudinally and a support plate 204 attached at one end portion of the duct 202 and formed transversally to the duct 202. The duct 202 has a longitudinally formed internal passage 206, contiguously providing an opening 208 in the support plate 204 at the one end portion of the duct 202. The internal passage 206 is shaped and dimensioned, such that the shoulder 104 and the arm 106 that is extended from and aligned with the shoulder 104 can fit and penetrate therethrough. The circumferences of the internal passage 206, the shoulder 104 and the arm 106 are shaped to be generally square, with the four corners that are cut out, in this example. The external circumference of the duct 202 is shaped to be hexagonal in this example; however, the shape can be of any other type as long as it gives structural stability. Some part of a foot may be placed on the top section, e.g., the three top surfaces of the hexagonal prism of the duct 202, in this example, which may have grooves 210 formed along the longitudinal direction to reduce transversal slippage of the foot. The back surface of the support plate 204 is shaped to be substantially flat so that the support plate 204 can be firmly flush against a wall of a utility structure when the present step assembly is installed. A weep line 212 may be formed on the back surface of the support plate 204 for water drainage.

When the present step unit is installed to a utility structure, one or more surfaces having the grooves 210 can be oriented to face toward substantially the ascending direction, i.e., the vertical direction, to provide a standing platform for the worker, thereby reducing transversal slippage of the foot and providing enhanced prevention from fall. To further enhance the stability of the plate member 200 installed, the location where the duct 202, which is elongated longitudinally, is attached to the support plate 204, which is formed transversally, may be off-centered to have the upper plate section above the duct 202 being smaller than the lower plate section. This design will utilize gravity to vertically stabilize the installed plate member 200 with minimal tilting. Furthermore, the present design helps workers/users to determine the directionality of the plate member 200 for installation; namely, it should be obvious to them that the one or more surfaces of the duct 202 having the grooves 210 should face vertically upward and the lower plate section, which is larger than the upper plate section, should point vertically downward.

Figure 13:
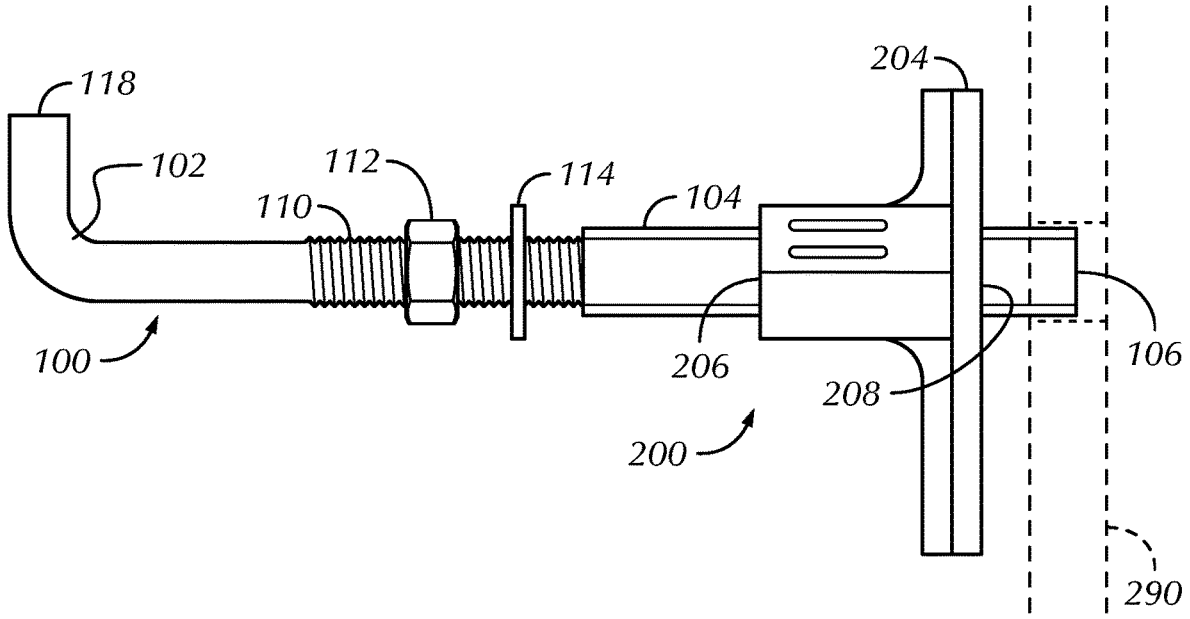
FIGS. 13 and 14 are side views of the present step assembly comprising the rod member and the plate member, showing two steps in the process of being installed to a wall of a utility structure.
Figure 14:
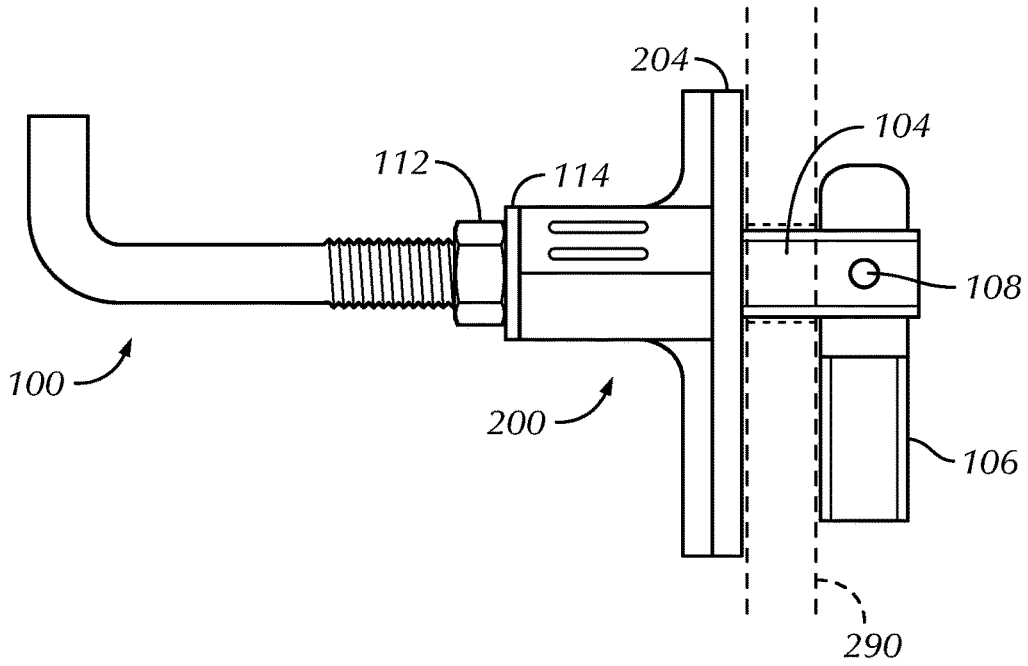

FIGS. 13 and 14 are side views of the present step assembly comprising the rod member 100 and the plate member 200, showing two steps in the process of being installed to a wall 290 of a utility structure. As mentioned earlier with reference to FIG. 4, a stopper 120 may optionally be included in the distal section of the arm 106. Prior to the installation, the stopper 120 as such a screw should be screwed in to have the top of the stopper 120 gets leveled with or lower than the surrounding surface, so that the stopper 120 does not interfere with the insertion operation in the following. In FIG. 13, the arm 106 is pivoted around the pin 108 to extend from and aligned with the shoulder 104, and the aligned shoulder 104 and arm 106 are inserted horizontally through the internal passage 206 of the plate member 200. In FIG. 13, part of the arm 106 is seen to be sticking out from the opening 208 of the support plate 204 and being inserted into a hole premade in the wall 290 of the utility structure, while the bent portion 118 of the generally L-shaped rod 102 is oriented vertically upright. In FIG. 14, the aligned shoulder 104 and arm 106 have been further inserted through the hole till the entire arm 106 is located on the other side of the wall. At this point, the arm 106 pivots around the pin 108; the distal section, which is longer than the proximal section, of the arm 106 hangs down vertically due to gravity; and the front surface of the arm 106 gets flush against the back surface of the wall 290. The position of the plate member 200 can be adjusted along the shoulder 104 until the back surface of the support plate 204 gets flush against the front surface of the wall 290. The fasteners such as the nut 112 and the washer 114 can be engaged with the thread 110 to fasten the rod member 100, the plate member 200 and the wall 290, by firmly pressing the wall 290 between the support plate 204 and the hanging arm 106.

After the installation as above, the present step assembly can be used for climbing the utility structure by putting a foot thereon. After the use, the present step assembly can be uninstalled from the utility structure. For doing so, the fasteners can be disengaged from the thread 110 to unfasten the rod member 100, the plate member 200 and the wall 290; the position of the plate member 200 can be adjusted to loosen the support plate 204 and the hanging arm 106 from the wall 290; the arm 106 gets pivoted back to orient in the horizontal direction because the long distal section gets pushed up by the wall 290 while the assembly is being pulled back away from the wall 290; the arm 106 gets generally aligned with the shoulder 104; and the entire step assembly can be pulled back off the wall 290 by letting the aligned shoulder 104 and arm 106 pass through the hole of the wall 290. Thus, the present step assembly is configured to be removable and reusable. As mentioned earlier, if the stopper 120 is included in the arm 106, the stopper 120 such as a screw can be turned to have its height higher than the surrounding surface of the arm 106, so as to prevent the arm 106 from sliding back out of the plate member 200. In this way, workers/users will less likely lose either member of the assembly after the un-installation.

Figure 15:
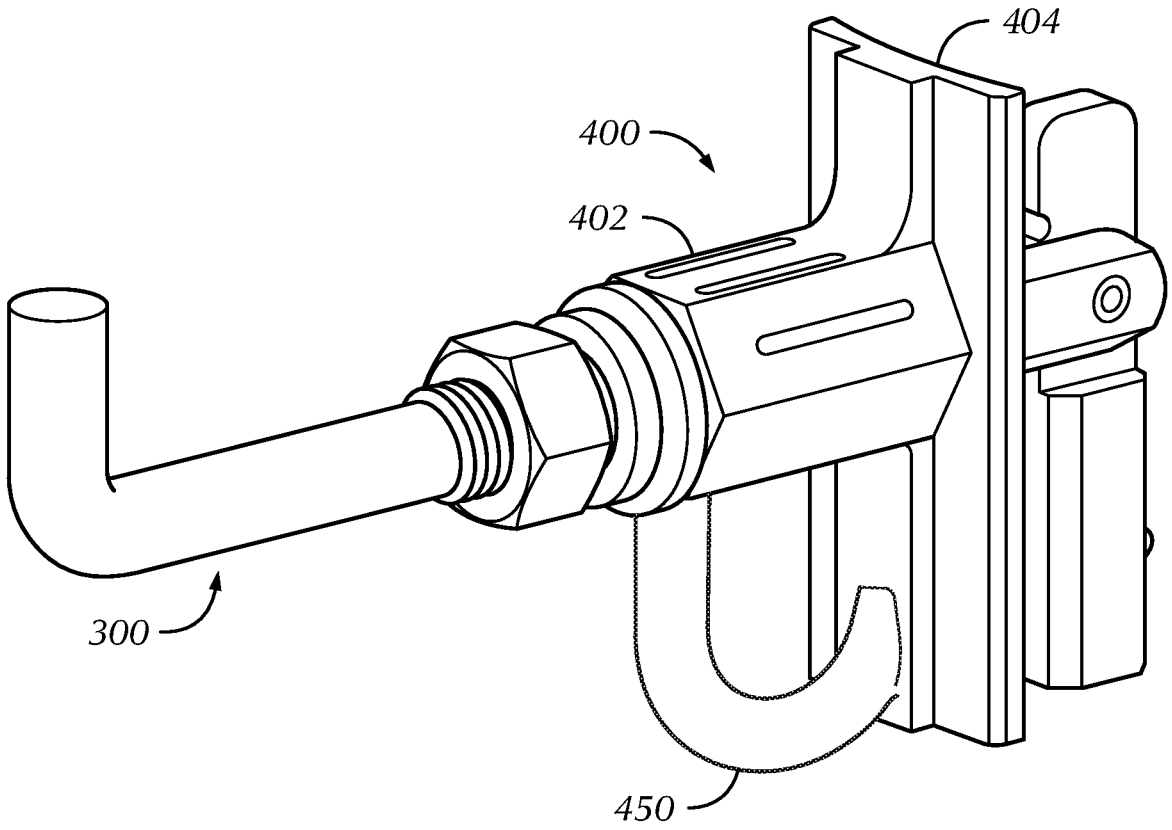
FIG. 15 is a front perspective view of a second embodiment of the present step assembly, in an assembled configuration.
Figure 16:
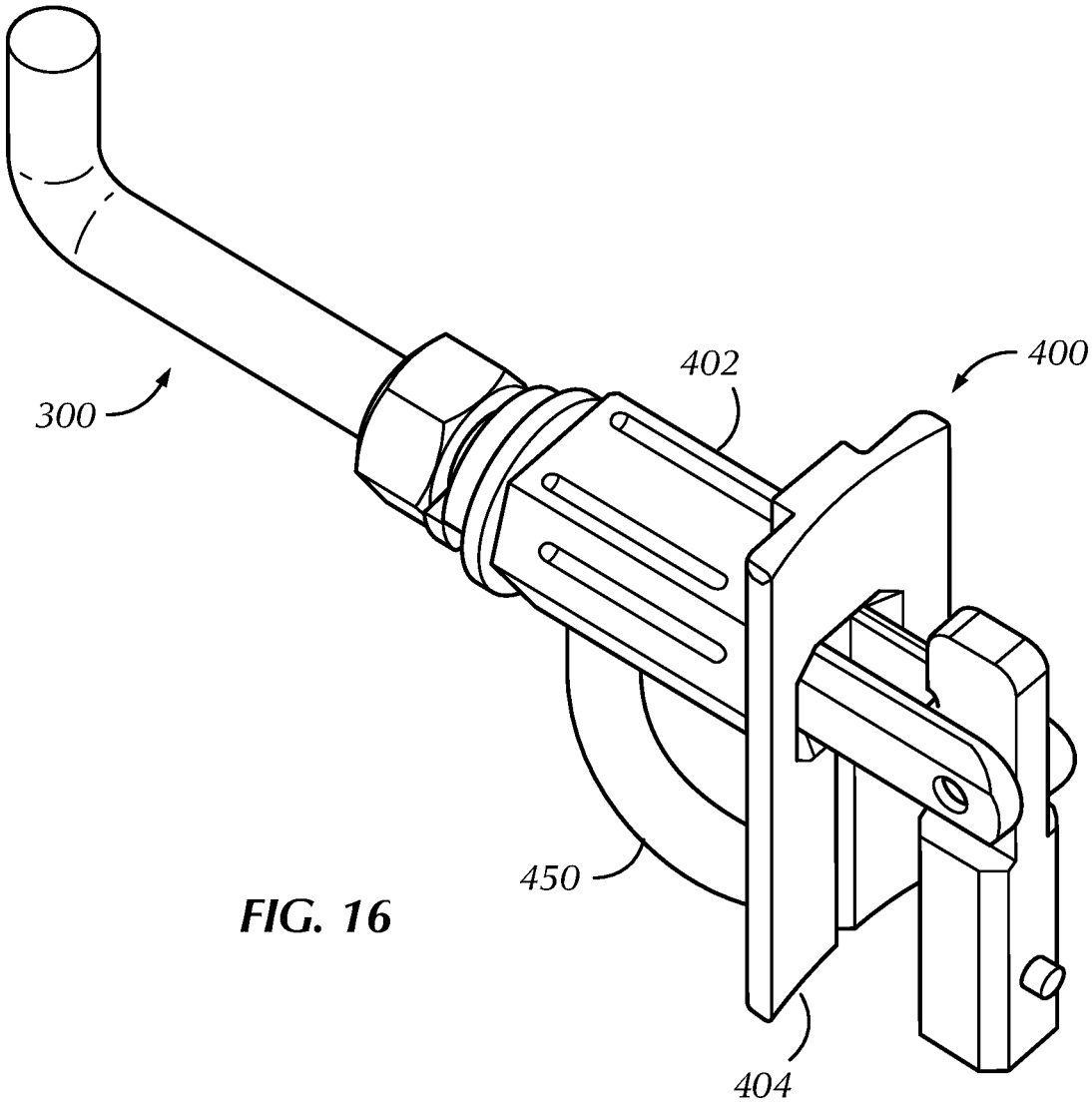
FIG. 16 is a rear perspective view thereof.
Figure 17A:
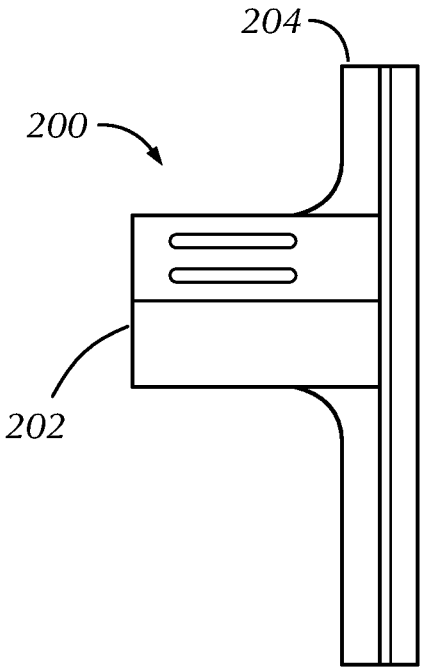
FIGS. 17A and 17B are side views of the plate member in the first and second embodiments, respectively.
Figure 17B:
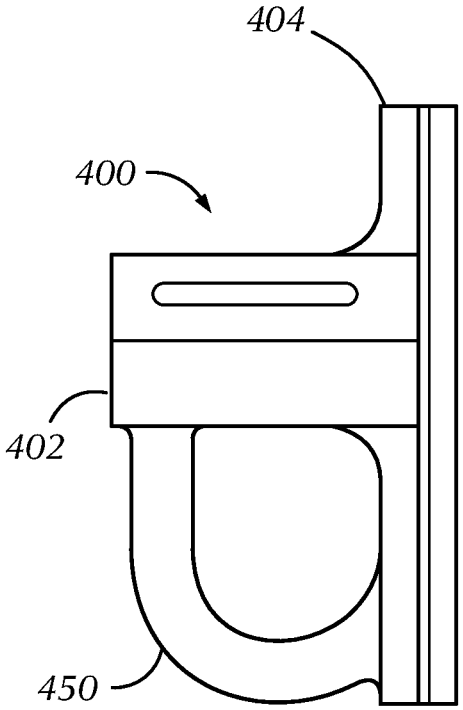

FIG. 15 is a front perspective view of a second embodiment of the present step assembly, in an assembled configuration. FIG. 16 is a rear perspective view thereof. The step assembly includes two main components: a rod member 300 and a plate member 400. The rod member 300 in the second embodiment may be configured similar to the rod member 100 in the first embodiment explained with reference to FIGS. 3-7. For comparison, FIGS. 17A and 17B illustrate side views of the plate member in the first and second embodiments, respectively. The plate member 400 in the second embodiment comprises: a duct 402 elongated longitudinally; a support plate 404 attached at one end portion of the duct 402 and formed transversally to the duct 402; and a fall arrest loop 450. The loop 450 has one end being integrally attached to the duct 402 and the other end being integrally attached to the support plate 404. The duct 402 has a longitudinally formed internal passage, contiguously providing an opening in the support plate 404 at the one end portion of the duct 402.

A mentioned earlier, when the present step unit is installed to a utility structure, one or more surfaces of the duct 402 having the grooves can be oriented to face toward substantially the ascending direction, i.e., the vertical direction, to provide a standing platform for the worker, thereby reducing transversal slippage of the foot and providing enhanced prevention from fall. To further enhance the stability of the plate member 400 installed, the location where the duct 402 is attached to the support plate 404 may be off-centered to have the upper plate section above the duct 402 is smaller than the lower plate section, so as to utilize gravity to vertically stabilize the installed plate member 400 with minimal tilting. Furthermore, the present design helps workers/users to determine the directionality of the plate member 400 for installation; namely, it should be obvious to them that the one or more surfaces of the duct 402 having the grooves should face vertically upward and the lower plate section, which is larger than the upper plate section, should point vertically downward.

The fall arrest loop 450 has a shape of generally an open loop. One end of the loop 450 is integrally attached to the duct 402, while the other end is integrally attached to the lower plate section of the support plate 404, which is larger than the upper plate section, thereby providing an opening defined by the loop 450, a portion of the duct 402 and a portion of the lower plate section of the support plate 404. Thus, the fall arrest loop 450 is configured for use as an anchorage of a fall arrest system.

With reference to FIGS. 17A and 17B, illustrating the side views of the plate member 200 in the first embodiment and the plate member 400 in the second embodiments, respectively, the dimensions of the duct 402 in the second embodiment may be configured larger than those of the duct 202 in the first embodiment. This is because the duct may have to sustain a heavier load due to the load added to the fall arrest loop 450.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A step assembly comprising:

a rod member comprising:

a generally L-shaped rod having a main rod elongated in a longitudinal direction and a bent portion elongated in a transversal direction and formed contiguously to one end of the main rod, wherein a thread is formed on a surface of at least part of the main rod, a shoulder formed longitudinally and contiguously to the other end of the main rod, and an arm pivotably coupled to the shoulder by a pin; and a plate member comprising:

a duct having a longitudinally formed internal passage, and a support plate attached at one end portion of the duct and formed transversally to the duct, wherein the internal passage of the duct is configured to contiguously provide an opening in the support plate at the one end portion of the duct.

2. The step assembly of claim 1, wherein the internal passage is configured for the shoulder and the arm extended from and aligned with the shoulder to fit and penetrate therethrough.

3. The step assembly of claim 1, wherein the pin is configured as an axis to couple the shoulder and the arm to enable a pivotal movement of the arm around the pin radially on a plane generally defined by the shoulder and the arm, wherein the axial direction of the pin is orthogonal to the direction of the bent portion of the generally L-shaped rod.

4. The step assembly of claim 3, wherein the pin is placed off-centered on the arm, providing a proximal section and a distal section, the proximal section being shorter than the distal section extending toward a 180° opposite direction with respect to the pin.

5. The step assembly of claim 4, wherein the distal section of the arm hangs down vertically due to gravity, when the shoulder is placed horizontally and the bent portion of the generally L-shaped rod is oriented vertically upright.

6. The step assembly of claim 4, wherein a socket is formed in the shoulder to accommodate the proximal section of the arm when the arm is pivoted back to extend from and generally align with the shoulder.

7. The step assembly of claim 1, wherein the rod member further comprises one or more fasteners for fastening by engaging with the thread.

8. The step assembly of claim 2, wherein circumferences of the internal passage, the shoulder and the arm are shaped to be generally square with four cut-out corners.

9. The step assembly of claim 1, wherein at least part of a surface of the duct has grooves formed longitudinally to reduce transversal slippage of a foot placed thereon.

10. The step assembly of claim 1, wherein a weep line is formed on a back surface of the support plate for water drainage.

11. The step assembly of claim 1, further comprising:

a fall arrest loop having one end being integrally attached to the duct and the other end being integrally attached to the support plate, providing an opening defined by the fall arrest loop, a portion of the duct and a portion of a lower plate section of the support plate.

12. The step assembly of claim 1, further comprising:

a stopper included in the arm, the stopper comprising a screw to be turned to have its height higher than a surrounding surface of the arm, in a configuration wherein the arm is inserted through the plate member, to prevent the arm from sliding back out of the plate member.

13. The step assembly of claim 1, wherein a surface other than the threaded surface of the generally L-shaped rod is knurled.

14. A method of installing the step assembly of claim 1 to a utility structure, the method comprising:

pivoting the arm around the pin to generally align the arm with the shoulder;

pushing the rod member to insert the aligned shoulder and arm of the rod member through the internal passage of the duct of the plate member;

pushing the step assembly to insert the arm coming out of the opening of the support plate of the plate member through a hole made in a wall of the utility structure, while keeping the bent portion of the generally L-shaped rod vertically upright;

pushing the rod member to locate the entire arm on a back side of the wall to let a distal section of the arm, which is configured to be longer than a proximal section, hang down vertically due to gravity;

adjusting a position of the plate member to firmly press the wall between the support plate and the hanging arm; and engaging one or more fasteners with the thread to fasten the rod member, the plate member and the wall.

15. A method of uninstalling the step assembly of claim 1 from a utility structure, the method comprising:

disengaging one or more fasteners from the thread to unfasten the rod member, the plate member and a wall of the utility structure;

adjusting a position of the plate member to loosen the support plate and the hanging arm from the wall;

pulling the rod member so that a longer section of the arm that was vertically hanging down is pushed up by the wall to have the arm pivoted back to generally align with the shoulder; and pulling the step assembly to let the aligned shoulder and arm pass through a hole made in the wall.

* * * * *